US005865055A

United States Patent [19]

Morozumi

[11] Patent Number: 5,865,055

[45] Date of Patent: Feb. 2, 1999

[54] SPLINE FORMING DIE

[75] Inventor: Katsuyuki Morozumi, Utsunomiya, Japan

[73] Assignee: Mitsubishi Steel Mfg. Co., Ltd., Tokyo, Japan

[21] Appl. No.: 781,268

[22] Filed: Jan. 10, 1997

[30] Foreign Application Priority Data

Apr. 15, 1996 [JP] Japan ..... 8-092648

[51] Int. Cl.[6] ..... B21B 13/10

[52] U.S. Cl. ..... 72/224

[58] Field of Search ..... 72/224, 212, 213, 72/208, 113

[56] References Cited

U.S. PATENT DOCUMENTS

| | | | |
|---|---|---|---|
| 1,513,565 | 10/1924 | Somersall | 72/224 |
| 3,983,733 | 10/1976 | Davis | 72/224 |

FOREIGN PATENT DOCUMENTS

| | | | |
|---|---|---|---|
| 2482483 | 11/1981 | France | 72/212 |
| 4-356324 | 12/1992 | Japan . | |
| 574259 | 9/1977 | U.S.S.R. | 72/224 |
| 634824 | 11/1978 | U.S.S.R. | 72/224 |

*Primary Examiner*—Daniel C. Crane
*Attorney, Agent, or Firm*—Flynn, Thiel, Boutell & Tanis, P.C.

[57] ABSTRACT

A spline forming die is made up of: upper and lower ring-shaped holders; and rollers vertically rotatably retained between the upper and lower holders and projected from a circumferential end of a holder. Using this spline forming die, splines having a stable precision in a spline-forming direction are formed by a press load due to the rotation of the rollers without the metal stock being subject to shearing friction. Further, a large module of splines can also be formed by setting the diameter of each of the rollers to a large size.

7 Claims, 3 Drawing Sheets

SPLINE FORMING DIE

BACKGROUND OF THE INVENTION

1. Field of the Invention

The present invention relates to a spline forming die to be used in forming splines by forging.

2. Description of the Prior Art

Conventionally, a ring-shaped die 1 of the type shown in FIG. 6 has been used in forming splines. A multiplicity of teeth 3 each having a cross-sectional shape corresponding to that of a spline are formed around the circumferential edge of a forming land 2 inside the ring-shaped die 1, and splines having a predetermined shape are formed by inserting a metal stock, which constitutes a shaft, into the forming land 2 by forging, and drawing (extruding) the metal stock by surface pressure and shearing friction due to the teeth 3.

However, in the case of the conventional die 1, a number of problems, such as wear and galling, occur in the teeth 3 at all times owing to shearing friction which works on a spline-forming portion of the metal stock while splines are being formed on the metal stock by the teeth 3. To avoid such problems, it has been necessary to take full account of the complicated surface treatment of the teeth 3 or the surface roughness of the metal stock.

Not only does complicated frictional behavior occurs unsteadily, but also the nonuniformity of the inner portions or the dimensions of individual metal stocks causes the frictional behavior to vary further complicatedly, so that unstable characteristics or dimensional errors occur in products.

In addition, it has been difficult to form large-module splines because of the limitation of plastic deformation due to the friction of the metal stock.

SUMMARY OF THE INVENTION

An object of the present invention is to solve the above-described problems and provide a spline forming die capable of forming splines without causing shearing friction.

The present invention provides a spline forming die which comprises upper and lower ring-shaped holders, and rollers vertically rotatably retained between the upper and lower holders and projected from a circumferential end of the holders. During the formation of splines, only loads normal to the surfaces of contact between the rollers and a metal stock work on the rollers, so that no shearing friction occurs and deformation characteristics are stabilized with respect to a spline-forming direction.

DETAILED DESCRIPTION OF THE PREFERRED EMBODIMENTS

Embodiments of the present invention will be described below with reference to the accompanying drawings.

Figure 1:
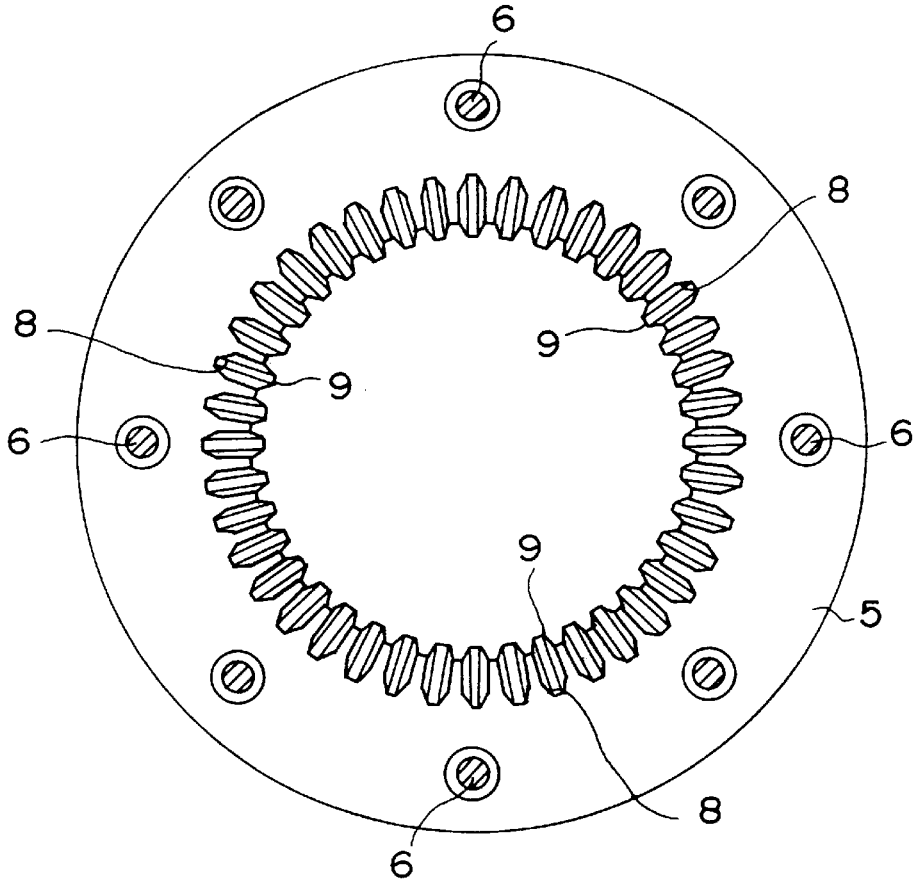
FIG. 1 is a cross-sectional view taken along line I—I of FIG. 2, showing one embodiment of the present invention.
Figure 2:
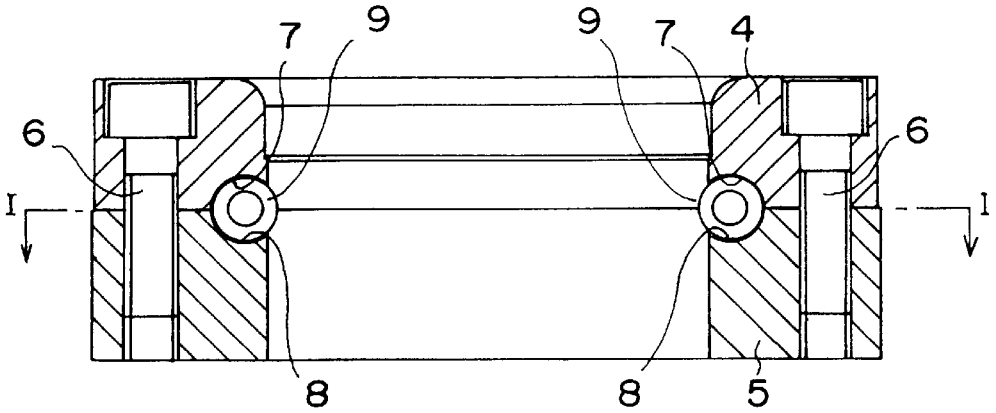
FIG. 2 is a longitudinal sectional front view of FIG. 1.

FIG. 1 is a cross-sectional view taken along line I—I of FIG. 2, showing one embodiment of the present invention, while FIG. 2 is a longitudinal sectional front view showing the embodiment of FIG. 1. A spline forming die according to the present invention is provided with an upper ring-shaped holder 4 and a lower ring-shaped holder 5. The inner and outer diameters of the upper holder 4 are approximately equal to the inner and outer diameters of the lower holder 5, respectively, and each of these inner diameters is equal to the outer diameter of a shaft on which to form splines. The upper holder 4 and the lower holder 5 are integrally connected coaxially with one vertical axis as the center by a plurality of bolts 6.

As shown in FIG. 2, a plurality of upper fitting grooves 7 each having the shape of an arc curved in one vertically inward direction are provided horizontally radially in the inner-diameter portion of the bottom of the upper holder 4. Similarly, a multiplicity of lower fitting grooves 8 each having the shape of an arc curved in the opposite vertically inward direction are provided horizontally radially in the inner-diameter portion of the top of the lower holder 5 in phase with the upper fitting grooves 7.

As many upper fitting grooves 7 and the lower fitting grooves 8 are provided as the number of splines to be formed. When the upper holder 4 and the lower holder 5 are integrally connected by the plurality of bolts 6, the arc-shaped portions of the upper fitting grooves 7 and those of the lower fitting grooves 8 are located on one circumference, and since each of the upper and lower fitting grooves 7 and 8 has a central angle slightly greater than 90°, the upper and lower fitting grooves 7 and 8 cooperate with each other in retaining rollers 9 so that they are vertically rotatably.

Figure 3:
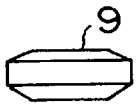
FIG. 3 is an enlarged plan view showing one embodiment of a roller.

As shown in FIG. 3 in enlarged plan view, each of the rollers 9 has a flat biconvex shape like a bead of a Japanese abacus, and the cross-sectional shape of the peripheral portion of each of the rollers 9 has the same size as the cross-sectional shape of each spline to be formed.

Figure 4:
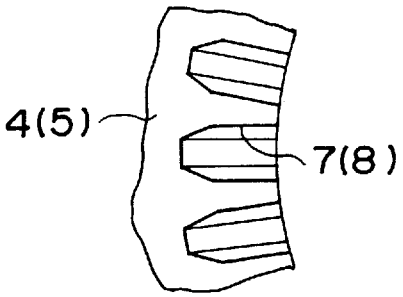
FIG. 4 is a fragmentary enlarged plan view showing one embodiment of a holder.

Each of the upper and lower fitting grooves 7 and 8 has the same cross-sectional shape as the peripheral portion of each of the rollers 9, as shown in FIG. 4. The radius and width of each of the upper and lower fitting grooves 7 and 8 are respectively approximately 0.1 mm greater than the radius and width of each of the rollers 9.

In assembly, the rollers 9 are fitted into all the lower fitting grooves 8 of the lower holder 5 before the upper holder 4 is connected to the lower holder 5, and then the upper holder 4 is placed onto the lower holder 5 so that the upper fitting grooves 7 are fitted onto the respective rollers 9. When the upper holder 4 and the lower holder 5 are integrally connected by the bolts 6, the upper and lower fitting grooves 7 and 8 are respectively located on circumferences having the same radius centered at one center of circle. Since each of the upper and lower fitting grooves 7 and 8 has a central angle slightly greater than 90° , the respective rollers 9 are retained loosely in nonescapable states in their vertical positions by the upper and lower fitting grooves 7 and 8, and are held in the state of projecting inward from the inner circumferential ends of the upper holder 4 and the lower holder 5. By supplying a lubricant to the surfaces of the respective rollers 9, the rollers 9 become able to smoothly rotate in the upper fitting grooves 7 and lower fitting grooves 8.

When splines are to be formed by using the spline forming die shown in FIGS. 1 and 2, the lubricant is applied to the rollers 9 and a metal stock on which to form splines by cold, warm or hot forging is moved past the inner circumferential portions of the upper holder 4 and the lower holder 5 which are integrally connected to each other.

While the metal stock is moving past the inner circumferential portions of the upper holder 4 and the lower holder 5, an angular moment occurs in the rollers 9 which are held in the state of projecting inward from the inner circumferential ends of the upper holder 4 and the lower holder 5, so that the rollers 9 start rotating.

As the rollers 9 rotate, the lubricant applied to the rollers 9 is supplied to the upper fitting grooves 7 and the lower fitting grooves 8 and a stable lubrication film is formed among the rollers 9, the upper fitting grooves 7 and the lower fitting grooves 8. Due to the lubricant, the metal stock is prevented from being fixed to the rollers 9 and the rollers 9 can continue to rotate smoothly while being held by the upper fitting grooves 7 and the lower fitting grooves 8.

As the rollers 9 rotate with the movement of the metal stock past the inner circumferential portion of the upper holder 4 and the lower holder 5, splines each having a precision which is stable in a spline-forming direction are formed by a press load due to the rotation of the rollers 9 without the metal stock being subject to shearing friction.

Since the metal stock is not subject to shearing friction and the press load due to the rotation of the rollers 9 acts on the metal stock, a large module of splines can also be formed by setting the diameter of each of the rollers 9 to a large size.

If the rollers 9 wear, the bolts 6 shown in FIG. 2 are removed and the upper holder 4 is separated from the lower holder 5 to replace the rollers 9. After the completion of replacement, the upper holder 4 is again placed onto the lower holder 5, and the upper holder 4 and the lower holder 5 are integrally connected by the bolts 6.

Figure 5:
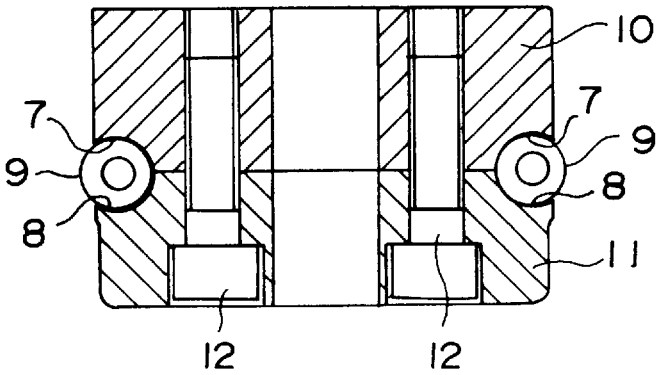
FIG. 5 is a longitudinal sectional front view showing another embodiment of the present invention.
Figure 6:
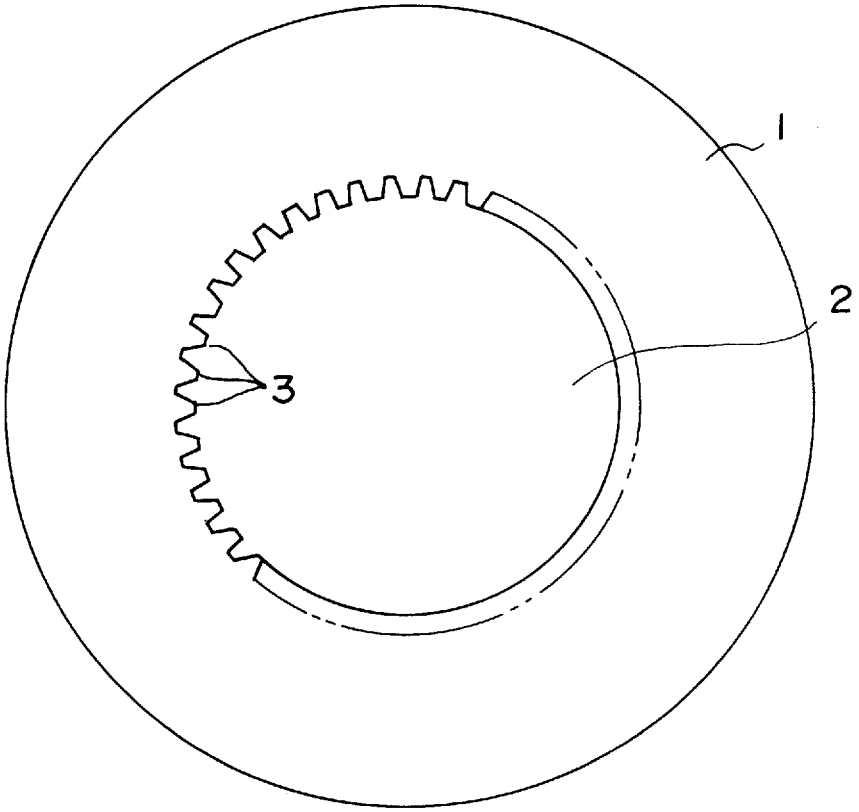
FIG. 6 PRIOR ART
FIG. 6 is a plan view showing one example of a conventional spline forming die.

FIG. 5 is a longitudinal sectional front view showing another embodiment of the present invention, and shows a spline forming die to be used in forming splines on the inner side of a hollow shaft.

The spline forming die shown in FIG. 5 is provided with an upper ring-shaped holder 10 and a lower ring-shaped holder 11. The inner and outer diameters of the upper holder 10 are approximately equal to the inner and outer diameters of the lower holder 11, respectively, and each of these outer diameters is equal to the inner diameter of a hollow shaft on which to form splines. The upper holder 10 and the lower holder 11 are integrally connected coaxially with one vertical axis as the center by a plurality of bolts 12.

The upper fitting grooves 7 are provided in the outer-diameter portion of the bottom of the upper holder 10, while the lower fitting grooves 8 are provided in the outer-diameter portion of the top of the lower holder 11. The rollers 9 which are rotatably retained by the upper fitting grooves 7 and the lower fitting grooves 8 are held in the state of projecting outward from the outer circumferential ends of the upper holder 10 and the lower holder 11.

If a metal stock is made to move past the outer circumferential portions of the upper holder 10 and the lower holder 11, which are integrally connected, splines each having a precision which is stable in a spline-forming direction are formed by a press load due to the rotation of the rollers 9 without the inner circumferential face of the hollow metal stock being subject to shearing friction.

In accordance with the present invention, since a metal stock on which it is desired to form splines are plastically deformed while angular moment is being caused in rollers, no shearing friction occurs between the metal stock and the rollers, so that splines having a stable high precision can be formed, and the forming load decreases and the life of the die can be made longer. In addition, a large module of splines can also be formed by setting the diameters of the rollers to optimum diameters. If the rollers wear, they can readily be replaced by disconnecting the holders from each other.

What is claimed is:

1. A spline forming die comprising upper and lower ring-shaped holders which are separable from each other and a plurality of rollers vertically rotatably retained between grooves provided in said upper and lower holders and projecting from circumferential ends of said upper and lower holders, said rollers being provided in spaced-apart relationship with respect to each other, the upper and lower ring shaped holders arranged so that each groove in the upper holder mates with a corresponding groove in the lower holder defining a plurality of paired grooves, each paired groove retaining a roller and being complementary to the shape of the retained roller and the upper and lower ring-shaped holders having a line of separation which approximately passes through the center of the rollers.

2. The spline forming die of claim 1, wherein opposite surfaces of said rollers are parallel to each other.

3. The spline forming die of claim 1, wherein a coaxial opening is provided in said upper and lower holders and said rollers are provided around the circumference thereof.

4. The spline forming die of claim 1, wherein said rollers are provided around an exterior surface of said upper and lower holders.

5. The spline forming die of claim 1, wherein said rollers are held in arc-shaped grooves provided in said upper and lower holders.

6. The spline forming die of claim 5, wherein the radius and width of each of the arc-shaped grooves are approximately 0.1 mm greater than that of the rollers.

7. The spline forming die of claim 5, wherein each of the arc-shaped grooves have a central angle greater than 90°.

* * * * *